US010219609B2

(12) United States Patent
Bryce

(10) Patent No.: US 10,219,609 B2
(45) Date of Patent: Mar. 5, 2019

(54) BACK PACK

(71) Applicant: Christine Bryce, Glen Cove, NY (US)

(72) Inventor: Christine Bryce, Glen Cove, NY (US)

( * ) Notice: Subject to any disclaimer, the term of this patent is extended or adjusted under 35 U.S.C. 154(b) by 0 days.

(21) Appl. No.: 15/893,686

(22) Filed: Feb. 11, 2018

(65) Prior Publication Data

US 2019/0038005 A1 Feb. 7, 2019

Related U.S. Application Data

(60) Provisional application No. 62/542,174, filed on Aug. 7, 2017.

(51) Int. Cl.
*A45F 3/00* (2006.01)
*A45F 3/04* (2006.01)

(52) U.S. Cl.
CPC ..... *A45F 3/04* (2013.01)

(58) Field of Classification Search
CPC .... A45F 3/00; A45F 3/04; A45F 3/047; A45F 2003/003
USPC ..... 224/259
See application file for complete search history.

(56) References Cited

U.S. PATENT DOCUMENTS 4,767,039 A * 8/1988 Jacober ..... A45C 11/20 224/153
5,060,314 A * 10/1991 Lewis ..... A62B 17/003 2/2.5
5,240,106 A * 8/1993 Plath ..... A45C 5/14 190/102
5,337,934 A * 8/1994 Johnson ..... A41D 13/0012 224/148.5
5,407,112 A * 4/1995 Christodoulou ..... A41D 15/04 2/94
5,743,447 A * 4/1998 McDermott ..... A45C 7/0068 224/153
D420,792 S * 2/2000 Sakelliou ..... D3/216
6,216,926 B1 * 4/2001 Pratt ..... A45F 3/04 224/148.2
6,305,590 B1 * 10/2001 Hayes ..... B62J 9/008 190/110
6,619,519 B1 * 9/2003 Nix ..... A45C 7/0086 224/153
7,152,772 B2 * 12/2006 Ukitsu ..... A45C 7/0086 224/660
2003/0000985 A1 * 1/2003 Schroeder ..... A45F 3/04 224/627
2008/0149679 A1 * 6/2008 Case ..... A45F 5/00 224/666
2009/0057359 A1 * 3/2009 Chen ..... A45F 3/08 224/261
2010/0163591 A1 * 7/2010 Stutz ..... A45F 3/04 224/579

(Continued)

*Primary Examiner* — Brian D Nash
(74) *Attorney, Agent, or Firm* — RG Patent Consulting, LLC; Rachel Gilboy

(57) ABSTRACT

An Improved Back Pack including a removable pouch member structured and arranged to be attached within a convenient backpack assembly to provide consumers, from school children to busy commuting adults, with a conveyance that allows for easier access to small personal items such as eyeglasses or sunglasses, cell phones, wallets, keys, makeup, and similar items, without having to remove the backpack simply to access these, and other frequently needed accessories.

15 Claims, 4 Drawing Sheets

(56) References Cited

U.S. PATENT DOCUMENTS

| | | | | |
|---|---|---|---|---|
| 2011/0309123 | A1* | 12/2011 | Ashenafi | A45F 3/14<br>224/627 |
| 2013/0181019 | A1* | 7/2013 | Salentine | A45F 5/00<br>224/242 |
| 2015/0053735 | A1* | 2/2015 | Murdoch | A45F 3/005<br>224/640 |

* cited by examiner

BACK PACK

CROSS-REFERENCE TO RELATED APPLICATION

The present application is related to and claims priority from prior provisional application Ser. No. 62/542,174, filed Aug. 7, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of pouch devices and more specifically relates to an improved back pack comprising a removable pouch member structured and arranged to be attached within a convenient backpack assembly to provide consumers, from school children to busy commuting adults, with a conveyance that allows for easier access to small personal items such as eyeglasses or sunglasses, cell phones, wallets, keys, makeup, and similar items, without having to remove the backpack simply to access these, and other frequently needed accessories.

2. DESCRIPTION OF THE RELATED ART

Every day, millions of American consumers embark from their homes carrying purses, satchels, backpacks, book bags and brief cases, loaded with myriad personal items and accessories. Whether a small child who crams lunch money, text books and homework in a book bag; a busy executive carrying a briefcase packed with contracts, business files and expense receipts; or a homemaker carrying a diaper bag filled with baby accessories, a wallet, cell phone and house keys, most people find that they rarely leave their home empty handed. Not limited to use by students, homemakers, or business professionals, these carryalls are also a "must have" commodity for those who commute to work every day via public transportation; riding a train or bus to the job requires that all necessary personal items are stowed in an enclosed bag that is easy to transport, particularly when such commutes can take up to an hour one way.

Unfortunately, actually carrying a loaded storage tote can sometimes be challenging. Particularly, when all of one's belongings are stuffed within a back-facing pack, the user has no choice but to lift the bag off the shoulders and bring it forward in order to access such a small, but necessary, item as a set of keys. Other personal goods, such as wallets, ID cards, writing utensils, smartphones, and sunglasses and eyeglasses are similarly difficult to retrieve with a standard backpack. As a result, many consumers find themselves lugging additional carrying bags to combat this challenge. Unfortunately, such a "solution: renders the point of a backpack pretty moot.

Various attempts have been made to solve problems found in pouch device art. Among these are found in: U.S. Pub. No. 2008/0029565 to Edwin Enriquez; U.S. Pub. No. 2005/0161485 to John Egart et al.; and U.S. Pat. No. 6,510,592 to Jeffrey R. Hamilton. This prior art is representative of pouch devices for backpacks.

Ideally, an improved back pack should be user-friendly and safe in-use and, yet should operate reliably and be manufactured at a modest expense. Thus, a need exists for an improved back pack comprising a removable pouch member structured and arranged to be attached within a convenient backpack assembly to provide consumers, from school children to busy commuting adults, with a conveyance that allows for easier access to small personal items such as eyeglasses or sunglasses, cell phones, wallets, keys, makeup, and similar items, without having to remove the backpack simply to access these, and other frequently needed accessories and to avoid the above-mentioned problems.

BRIEF SUMMARY OF THE INVENTION

In view of the foregoing disadvantages inherent in the known pouch device art, the present invention provides an Improved Back Pack. The general purpose of the present invention, which will be described subsequently in greater detail is to provide an Improved Back Pack comprising a removable pouch member structured and arranged to be attached within a convenient backpack assembly to provide consumers, from school children to busy commuting adults, with a conveyance that allows for easier access to small personal items such as eyeglasses or sunglasses, cell phones, wallets, keys, makeup, and similar items, without having to remove the backpack simply to access these, and other frequently needed accessories.

An improved back pack comprises a main body and a removable pouch member. The main body includes front portion; a back portion including a top portion; and a bottom portion; and two strap members. The back portion is attached to the front portion and forms an interior volume therebetween. The back portion is detachable from the front portion via a zipper member connected along a length therebetween. Wherein the two strap members are spaced from one another and respectively attached between the top portion and the bottom portion of the back portion. Wherein the two strap members are adapted to removably reside upon respective shoulder members of a user. Wherein a first of the two strap members includes a connector member thereon. Wherein a second of the two strap members includes two connector members thereon spaced from one another along a length of the second strap member between the top portion and the bottom portion of the back portion.

The removable pouch member comprises: a main body; front portion; a back portion; a first connector member; and a second connector member. The main body including: a top portion including a first end portion and a second end portion. The second end portion is located opposite from the first end portion. The front portion includes an elongated slit therethrough and a detachable connector member extending along a length of said slit and adapted to selectively open and close said slit. Wherein the back portion is attached to the front portion and forms an interior volume therebetween.

Wherein the first connector member is attached to the first end portion of the top portion. Wherein the first connector member is adapted to be selectively and removably connected to one of the two connector members of the second strap member of the main body. Wherein the second connector member is attached to the second end portion of the top portion.

Wherein the second connector member is adapted to be selectively and removably connected to either one of the connector member of the first strap member of the main body or a second of the two connector members of the second strap member. Wherein the pouch member is adapted to be selectively attached either between the two strap members or attached to only the second strap member of the main body.

The present invention holds significant improvements and serves as an Improved Back Pack For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, an Improved Back Pack, constructed and operative according to the teachings of the present invention.

The various embodiments of the present invention will hereinafter be described in conjunction with the appended drawings, wherein like designations denote like elements.

DETAILED DESCRIPTION

Figure 1:
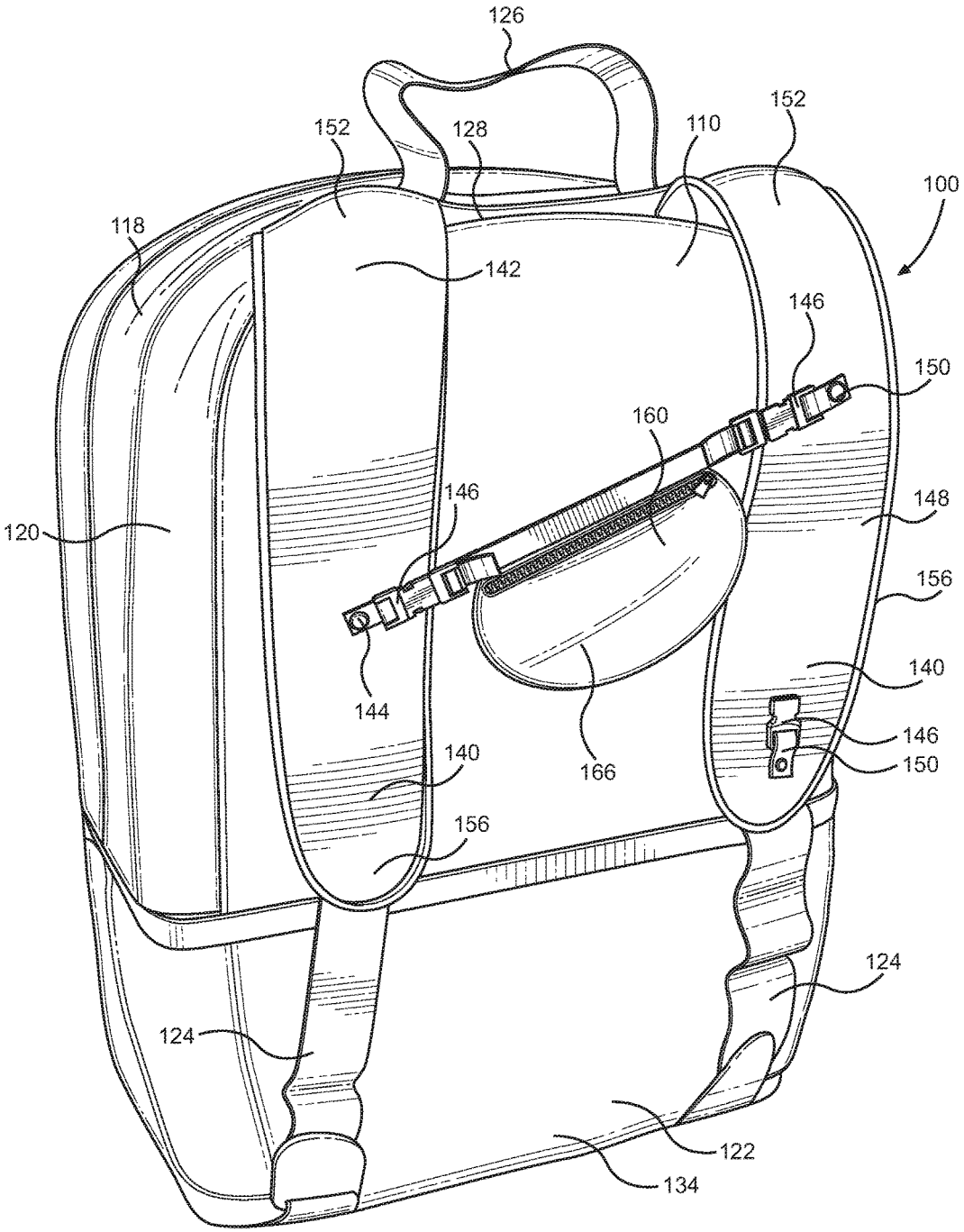
FIG. 1 shows a perspective view illustrating an Improved Back Pack according to an embodiment of the present invention.

As discussed above, embodiments of the present invention relate to a pouch device and more specifically relates to an Improved Back Pack comprising a removable pouch member structured and arranged to be attached within a convenient backpack assembly to provide consumers, from school children to busy commuting adults, with a conveyance that allows for easier access to small personal items such as eyeglasses or sunglasses, cell phones, wallets, keys, makeup, and similar items, without having to remove the backpack simply to access these, and other frequently needed accessories.

Generally speaking, the Improved Back Pack comprises a specially designed modified carrying bag system that features an additional, front-facing pouch that allows for easy packing and more importantly, easier accessibility of a multitude of personal items. Each bag will preferably be similar in appearance to a standard backpack and could be produced using reinforced, waterproof textile material such as durable and breathable Gore-Tex. Each Improved Back Pack backpack could be essentially oval in shape and sized copiously to house a wide array of both personal, business, and school-related items. Positioned on the back of the pack will preferably be two adjustable shoulder straps designed for easy transport, to accommodate each user's individual body type, and to offer resistance and connectability. Yet, it is the Improved Back Pack itself that will preferably render this product a cut above the common backpack.

Each strap that loops over the shoulders will preferably have an eyelet at the top, connected to a center strap that suspends the pouch. Placed in the middle of this strap will preferably be a rectangular zippered bag, sized appropriately to house one's frequently needed personal items. This product could feature a handy side pocket, into which the strap connected Pouch could be placed. The Improved Back Pack could be produced in a variety of colors to appeal to individual tastes, as well as in more professional, neutral hues of black, beige, or brown.

The Improved Back Pack will preferably provide a more user-friendly means of bearing and carrying bags that house a wide variety of professional and personal items. Configured with an attached, front-facing storage conveyance, the Improved Back Pack system will preferably ensure that everything one needs can be conveniently retrieved, without having to take the entire bag off the shoulders. As such, this creative product invention will provide completely hands-free transport of anything one needs. This advantage will preferably prove especially beneficial to daily commuters, as they will preferably not have to worry about juggling additional means of storage, such as purses, shopping bags and similar, in addition to a backpack. Also, this product line will preferably effectively ease the burdens faced by students as they navigate the halls of school or the grounds of a campus. Cleverly constructed, the Improved Back Pack should receive a wide and enthusiastic market response.

Referring now to FIGS. 1-5, showing perspective views illustrating improved back pack 100 according to an embodiment of the present invention.

Improved back pack 100 comprises main body 110 and removable pouch member 160. Main body 110 includes front portion 116; back portion 122 including top portion 128; and bottom portion 134; and two strap members 140. Back portion 122 is attached to front portion 116 and forms interior volume 120 therebetween. Back portion 122 is detachable from front portion 116 via zipper member 118 connected along a length therebetween.

Wherein two strap members 140 are spaced from one another and respectively attached between top portion 128 and bottom portion 134 of back portion 122. Wherein two strap members 140 are adapted to removably reside upon respective shoulder members of a user as shown in in-use condition 500 of FIG. 5. Wherein first 142 of two strap members 140 includes connector member 144 thereon. Wherein second 148 of two strap members 140 includes two connector members 150 thereon spaced from one another along a length of second strap member 148 between top portion 128 and bottom portion 134 of back portion 122.

Wherein back portion 122 of main body 110 further includes two side pockets 124 on opposite side portions thereof. Wherein back portion 122 of main body 110 further includes strap member 126 on top portion 128 thereof.

Wherein connector members 144 and 150 of two strap members 140 are pivotably attached thereto. Wherein connector members 144 and 150 of two strap members 140 are formed as eyelet members 146. Wherein two strap members 140 of main body 110 each have front surface 152 and back surface 156; and wherein each connector member 144 and 150 is attached to a respective front surface 152 thereof, such that pouch member 160 is adapted to reside upon a chest area of user 510. Wherein two strap members 140 are adjustable in length.

Figure 3:
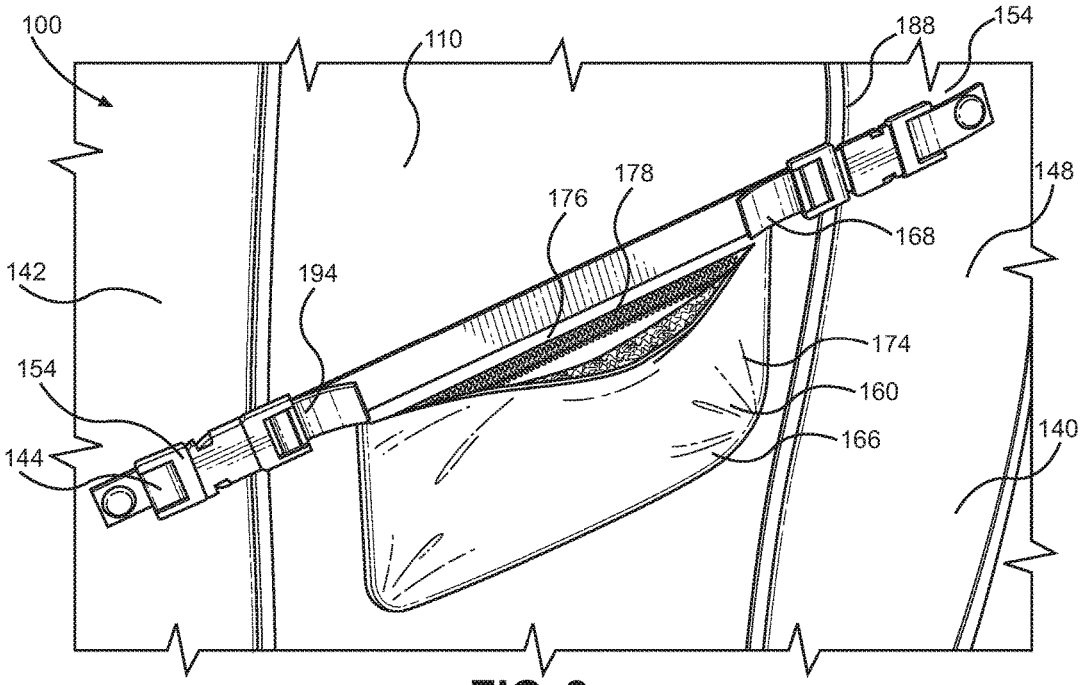
FIG. 3 is an expanded view illustrating the removable pouch member of the Improved Back Pack in an in-use condition according to an embodiment of the present invention.

Removable pouch member 160 comprises: main body 166; front portion 174; back portion 182; first connector member 188; and second connector member 194. Main body 166 including: top portion 168 including first end portion 170 and second end portion 172. Second end portion 172 is located opposite from first end portion 170. Wherein first end portion 170 and second end portion 172 of top portion 168 of main body 166 of pouch member 160 are adjustable in length. Wherein pouch member 160 may be formed having an oval shape as shown in FIG. 1. Wherein pouch member 160 may be formed having a rectangular shape as shown in FIG. 3.

Figure 2:
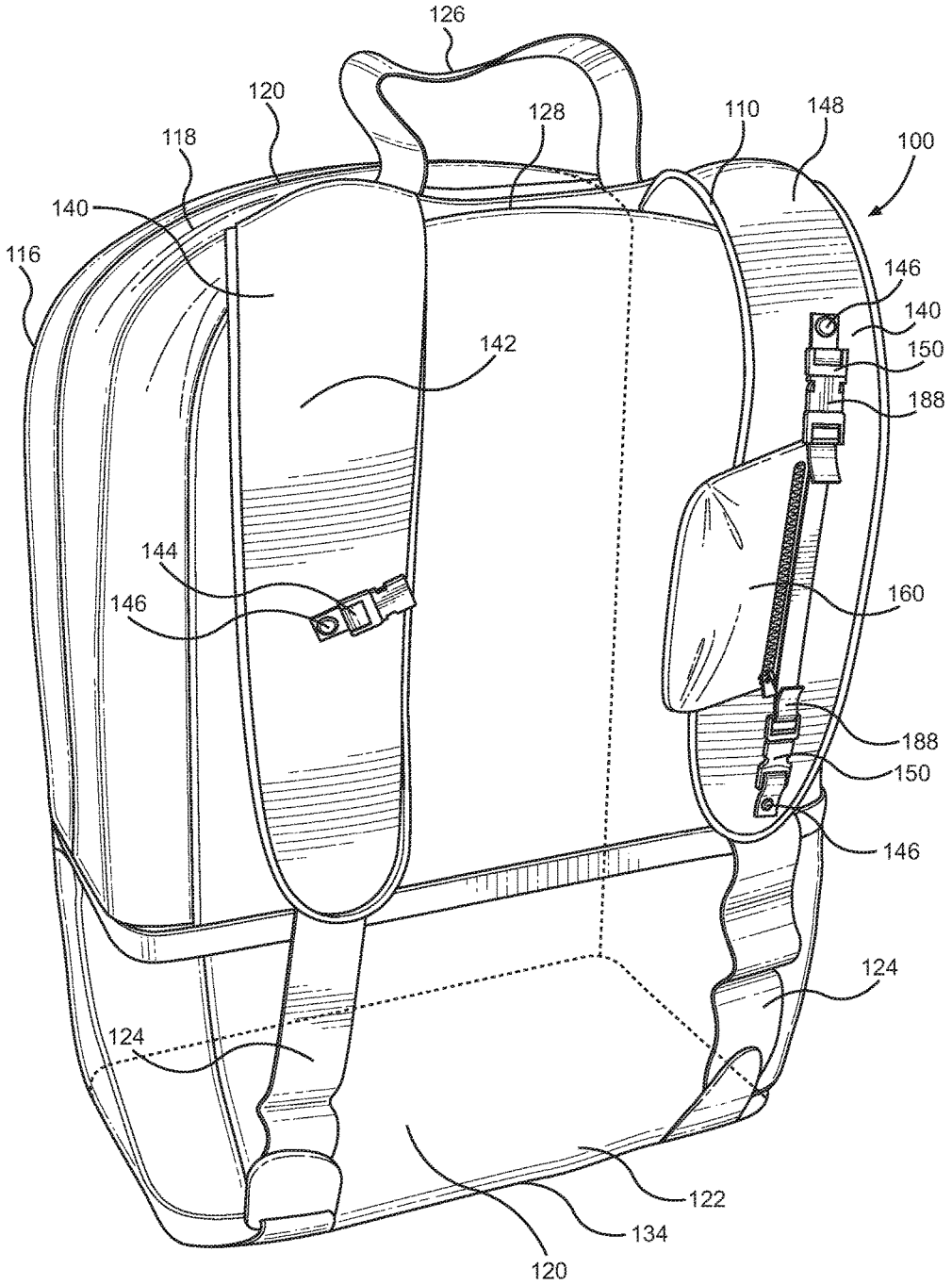
FIG. 2 shows a perspective view illustrating a removable pouch member attached to only a second strap member of the Improved Back Pack according to an embodiment of the present invention.
Figure 4:
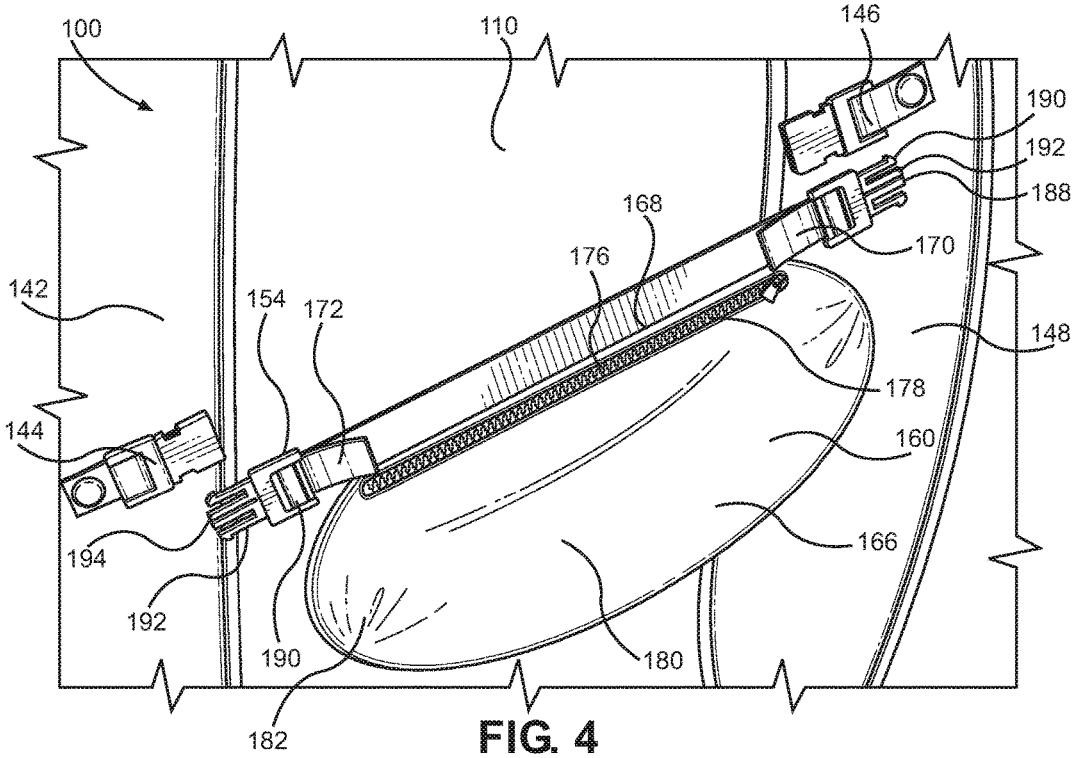
FIG. 4 is a view illustrating connector members of the two strap members and the connector members of the removable pouch member of the Improved Back Pack Device according to an embodiment of the present invention of FIG. 1.
Figure 5:
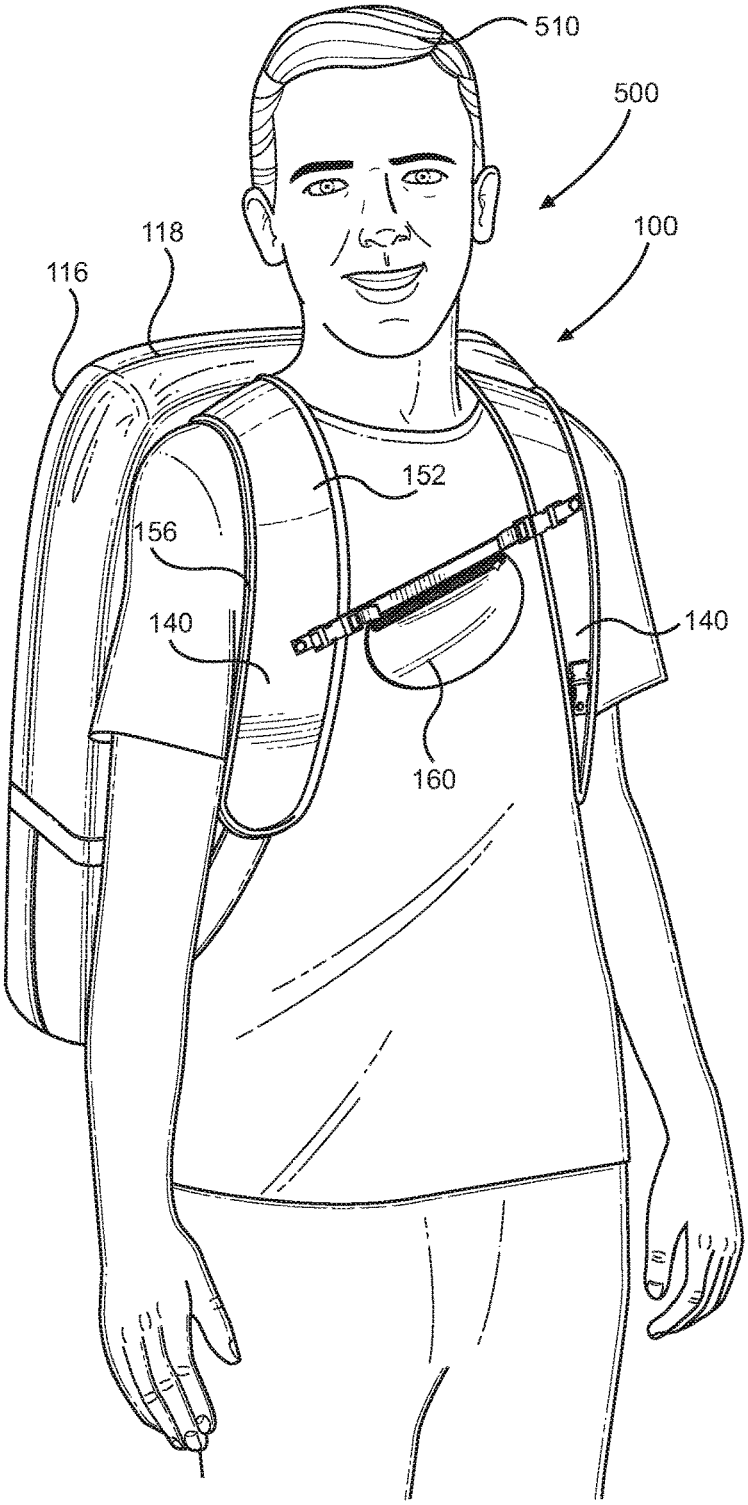
FIG. 5 shows a perspective view illustrating the Improved Back Pack in an in-use condition according to an embodiment of the present invention.

Front portion 174 includes elongated slit 176 therethrough and detachable connector member 178 extending along a length of slit 176 and adapted to selectively open and close slit 176. Wherein detachable connector member 178 of said slit member 176 is formed from hook and loop material as shown in FIG. 3. Wherein detachable connector member 178 of slit member 176 is formed as a zipper member as shown in FIG. 4.

Wherein back portion 182 is attached to front portion 174 and forms interior volume 180 therebetween. Wherein back portion 182 and front portion 174 of pouch member 160 are formed from reinforced textile material. Wherein the reinforced textile material is GORE-TEX.

Wherein first connector member 188 is attached to the first end portion 170 of top portion 168. Wherein first connector member 188 is adapted to be selectively and removably connected to one of two connector members 150 of second strap member 148 of main body 120. Wherein second connector member 194 is attached to second end portion 172 of top portion 168.

Wherein second connector member 194 is adapted to be selectively and removably connected to either one of connector member 144 of first strap member 142 of main body 110 or second of two connector members 150 of second strap member 148. Wherein pouch member 160 is adapted to be selectively attached either between two strap members 140 or attached to only second strap member 148 of main body 110 as shown in FIG. 2.

Wherein first connector member 188 and second connector member 194 of pouch member 160 are formed as clip members 190 adapted to be releasably connected to respective eyelet members 146. Wherein connector members 144 and 150 of two strap members 140 are formed as female clip members 154; and wherein first connector member 188 and second connector member 194 of pouch member 160 are formed as male clip members 192.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An improved back pack comprising:

a main body including:
- a front portion;
- a back portion including;
  - a top portion; and
  - a bottom portion;
  - wherein said back portion of said main body is attached to said front portion of said main body and forms an interior volume therebetween; and
  - wherein said back portion of said main body is detachable from said front portion of said main body via a zipper member connected along a length therebetween; and
- two strap members;
  - wherein said two strap members are spaced from one another and respectively attached between said top portion of said main body and said bottom portion of said main body of said back portion of said main body; and
  - wherein said two strap members are adapted to removably reside upon respective shoulder members of a user;
  - wherein a first of said two strap members includes a connector member thereon; and
  - wherein a second of said two strap members includes two connector members thereon spaced from one another along a length of said second strap member between said top portion of said main body and said bottom portion of said back portion of said main body; and a removable pouch member comprising:
- a main body including:
  - a top portion including;
    - a first end portion; and
    - a second end portion;
      - wherein said second end portion of said top portion of said main body of said removable pouch member is located opposite from said first end portion of said top portion of said main body of said removable pouch member;
  - a front portion including;
    - an elongated slit therethrough; and
    - a detachable connector member extending along a length of said elongated slit and adapted to selectively open and close said elongated slit;
  - a back portion;
    - wherein said back portion is attached to said front portion of said main body of said removable pouch member and forms an interior volume therebetween;

a first connector member;

wherein said first connector member is attached to said first end portion of said top portion of said main body of said removable pouch member; and wherein said first connector member is adapted to be selectively and removably connected to one of said two connector members of said second strap member of said main body; and a second connector member;

wherein said second connector member is attached to said second end portion of said top portion of said main body of said removable pouch member; and wherein said second connector member is adapted to be selectively and removably connected to either one of said connector member of said first strap member of said main body or a second of said two connector members of said second strap member of said main body;

wherein said pouch member is adapted to be selectively attached either between said two strap members of said main body or attached to only said second strap member of said main body.

2. The improved back pack of claim 1, wherein said connector members of said two strap members are pivotably attached thereto.

3. The improved back pack of claim 2, wherein said connector members of said two strap members are formed as eyelet members; and wherein said first and second connector members of said pouch member are formed as clip members adapted to be releasably connected to respective said eyelet members.

4. The improved back pack of claim 1, wherein said connector members of said two strap members are formed as female clip members; and wherein said first and second connector members of said pouch member are formed as male clip members.

5. The improved back pack of claim 1, wherein said detachable connector member of said slit member is formed from hook and loop material.

6. The improved back pack of claim 1, wherein said detachable connector member of said slit member is formed as a zipper member.

7. The improved back pack of claim 1, wherein said first and second end portions of said top portion of said main body of said pouch member are adjustable in length.

8. The improved back pack of claim 1, wherein said two strap members of said main body each have a front surface and a back surface; and wherein each said connector member is attached to a respective said front surface thereof, such that said pouch member is adapted to reside upon a chest area of a user.

9. The improved back pack of claim 1, wherein said pouch member is formed having an oval shape.

10. The improved back pack of claim 1, wherein said two strap members are adjustable in length.

11. The improved back pack of claim 1, wherein said back portion of said main body further includes two side pockets on opposite side portions thereof.

12. The improved back pack of claim 1, wherein said back portion and said front portion of said pouch member are formed from reinforced textile material.

13. The improved back pack of claim 12, wherein said reinforced textile material is GORE-TEX.

14. The improved back pack of claim 1, wherein said pouch member is formed having a rectangular shape.

15. The improved back pack of claim 1, wherein said back portion of said main body further includes an additional strap member spaced from said two strap members and attached to said top portion of said main body.

* * * * *